US009316998B2

(12) United States Patent
Imanaka

(10) Patent No.: US 9,316,998 B2
(45) Date of Patent: Apr. 19, 2016

(54) IMAGE FORMING APPARATUS WITH INNER COVER THAT SHIELDS AN OPTICAL SENSOR WHEN AN OUTER HOUSING COVER IS CLOSED, THE OPTICAL SENSOR USED FOR DETECTING WHETHER A WASTE TONER CASE IS FULL

(71) Applicant: KYOCERA DOCUMENT SOLUTIONS INC., Osaka (JP)

(72) Inventor: Koichi Imanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/250,418

(22) Filed: Apr. 11, 2014

(65) Prior Publication Data

US 2014/0321867 A1 Oct. 30, 2014

(30) Foreign Application Priority Data

Apr. 24, 2013 (JP) ..... 2013-090900

(51) Int. Cl.
*G03G 15/08* (2006.01)
*G03G 21/12* (2006.01)
*G03G 21/16* (2006.01)

(52) U.S. Cl.
CPC ..... *G03G 21/12* (2013.01); *G03G 21/1633* (2013.01)

(58) Field of Classification Search
CPC .... G03G 21/12; G03G 21/1633; G03G 21/10
See application file for complete search history.

(56) References Cited

U.S. PATENT DOCUMENTS

2010/0166441 A1* 7/2010 Kobayashi ..... G03G 21/12 399/35

FOREIGN PATENT DOCUMENTS

| | | | |
|---|---|---|---|
| JP | S60-120384 | * | 6/1985 |
| JP | 2002-169441 A | | 6/2002 |
| JP | 2014-212568 A | | 7/2004 |
| JP | 2008-134398 | * | 6/2008 |
| JP | 2011-039167 | * | 2/2011 |

OTHER PUBLICATIONS

An Office Action; "Notice of Reasons for Rejection," issued by the Japanese Patent Office on Jul. 14, 2015, which corresponds to Japanese Patent Application No. 2013-090900 and is related to U.S. Appl. No. 14/250,418.

* cited by examiner

*Primary Examiner* — David Gray
*Assistant Examiner* — Andrew V Do
(74) *Attorney, Agent, or Firm* — Studebaker & Brackett PC

(57) ABSTRACT

An image forming apparatus includes a waste toner case, an optical sensor, a cover and a shading member. The waste toner case is attachably/detachably provided in an apparatus main body via an opening part. The waste toner case collects a waste toner ejected from an image forming part forming an image by a toner. The optical sensor detects whether or not the waste toner case is filled with the waste toner. The cover closes the opening part of the apparatus main body. The shading member is arranged between the cover and optical sensor. The shading member covers the optical sensor in a state where the cover is closed.

7 Claims, 16 Drawing Sheets

IMAGE FORMING APPARATUS WITH INNER COVER THAT SHIELDS AN OPTICAL SENSOR WHEN AN OUTER HOUSING COVER IS CLOSED, THE OPTICAL SENSOR USED FOR DETECTING WHETHER A WASTE TONER CASE IS FULL

INCORPORATION BY REFERENCE

This application is based on and claims the benefit of priority from Japanese Patent application No. 2013-090900 filed on Apr. 24, 2013, the entire contents of which are incorporated herein by reference.

BACKGROUND

The present disclosure relates to an image forming apparatus preferably applied as a copying machine, a printer or the like.

There is an image forming apparatus provided with a waste toner case collecting a toner (hereinafter, called as a "waste toner") remained on a photoreceptor after a toner image is transferred on a sheet.

For example, the image forming apparatus includes the waste toner case and a transmissive optical sensor. The waste toner case has a thin wall part protruding from a case main body in which the waste toner is stored. The optical sensor has a light projection part and a light reception part arranged at positions interposing the thin wall part from both sides. In this image forming apparatus, light from the light projection part is transmitted through the thin wall part and received by the light reception part. When the inside of the thin wall part is filled with the waste toner, the waste toner obstructs the light from the light projection part. Therefore, a fill state (a replacement time) of the waste toner case is detected. The waste toner case with a filled waste toner is detached by a user from a placed part arranged in a cover.

In the image forming apparatus, the waste toner case is temporarily placed to the placed part. The waste toner case has a positioning part. The cover has a pressuring part. The waste toner case is positioned and fixed by the positioning part and pressuring part in accordance with a close operation of the cover. Then, a collecting port of the waste toner case is connected to a conveying pipe.

However, in the above-mentioned image forming apparatus, it is difficult to correctly detect the fill (replacement) of the waste toner case by the optical sensor. For example, in a case where an installation place is irradiated with sunlight or the like case, the optical sensor reacts to strong light transmitted through the cover. Therefore, the fill detection of the waste toner case is not carried out with accuracy.

In addition, the above-mentioned image forming apparatus is provided with a dedicated member in order to position and fix the waste toner case to the cover.

SUMMARY

An image forming apparatus of one aspect of the present disclosure includes a waste toner case, an optical sensor, a cover and a shading member. The waste toner case is attachably/detachably provided in an apparatus main body via an opening part. The waste toner case collects a waste toner ejected from an image forming part forming an image by a toner. The optical sensor detects whether or not the waste toner case is filled with the waste toner. The cover closes the opening part of the apparatus main body. The shading member is arranged between the cover and optical sensor. The shading member covers the optical sensor in a state where the cover is closed.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference to the appended drawings, a color printer as an image forming apparatus according to an embodiment of the present disclosure will be described. It is noted that, in the following description, a front side of the color printer 1 is defined by an arrow Fr shown in FIG. 1 and respective directions are defined by arrows shown in the figures, for convenience.

Figure 1:
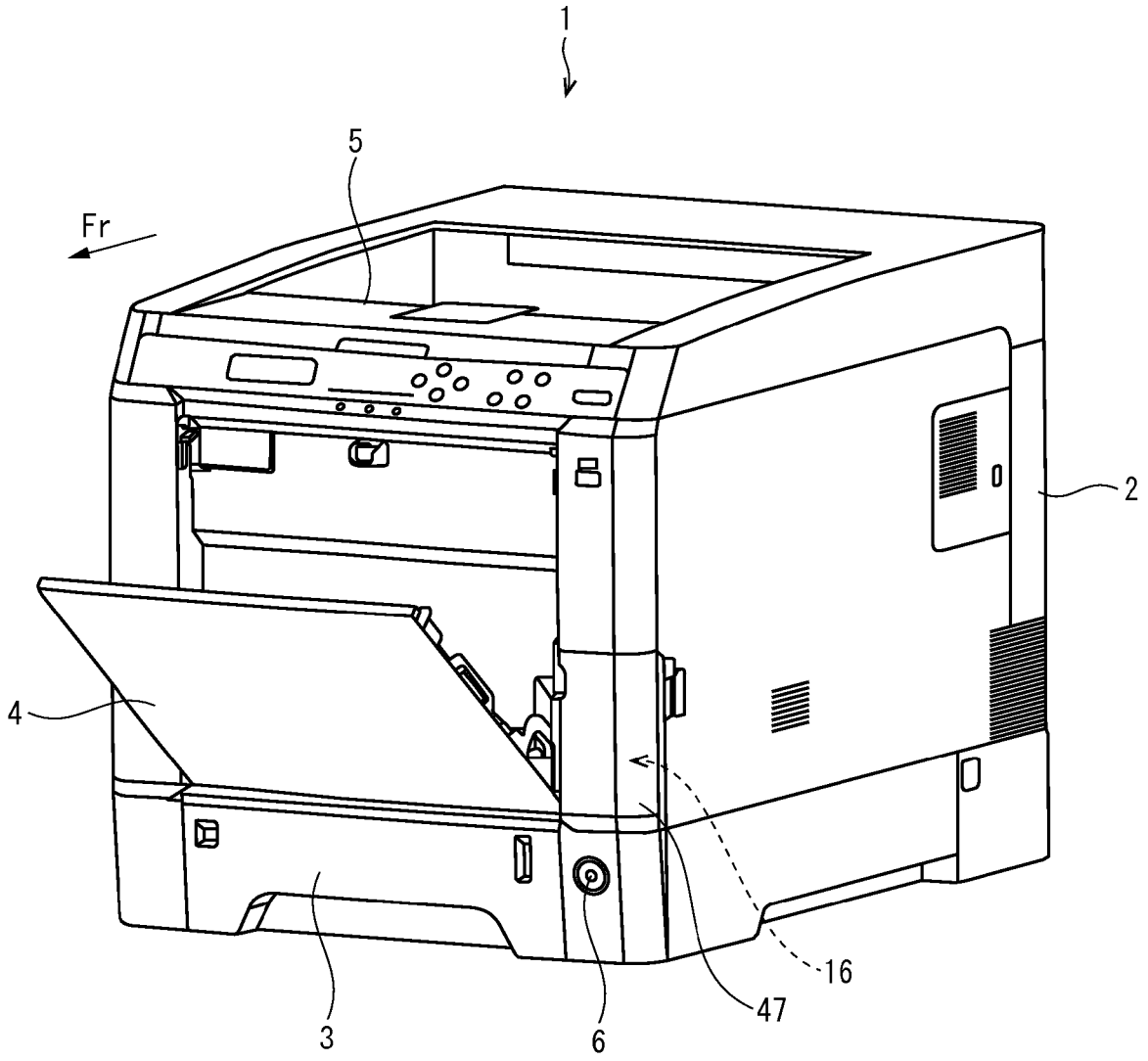
FIG. 1 is a perspective view showing a color printer according to an embodiment of the present disclosure.
Figure 2:
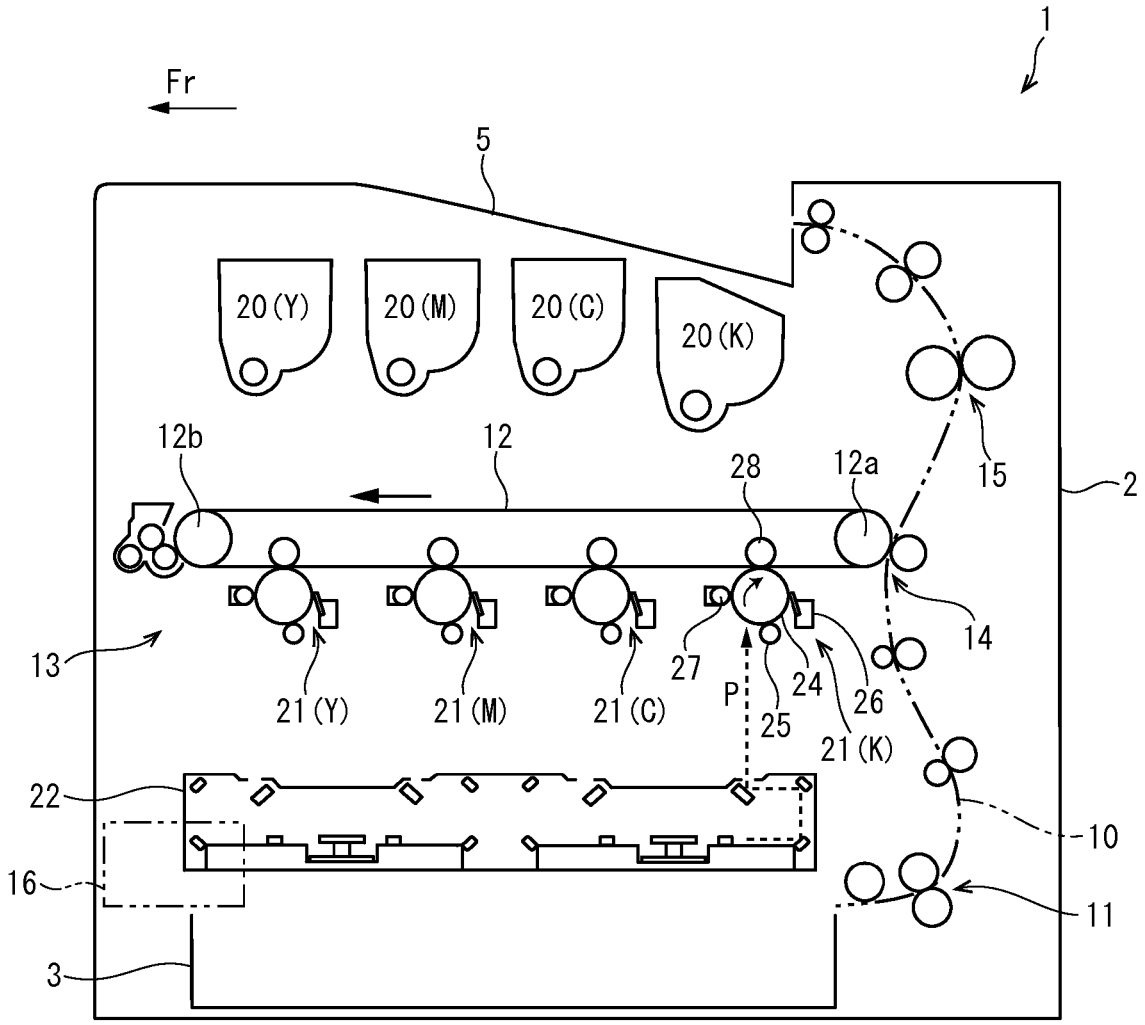
FIG. 2 is a sectional view schematically showing an internal structure of the color printer according to the embodiment of the present disclosure.
Figure 3:
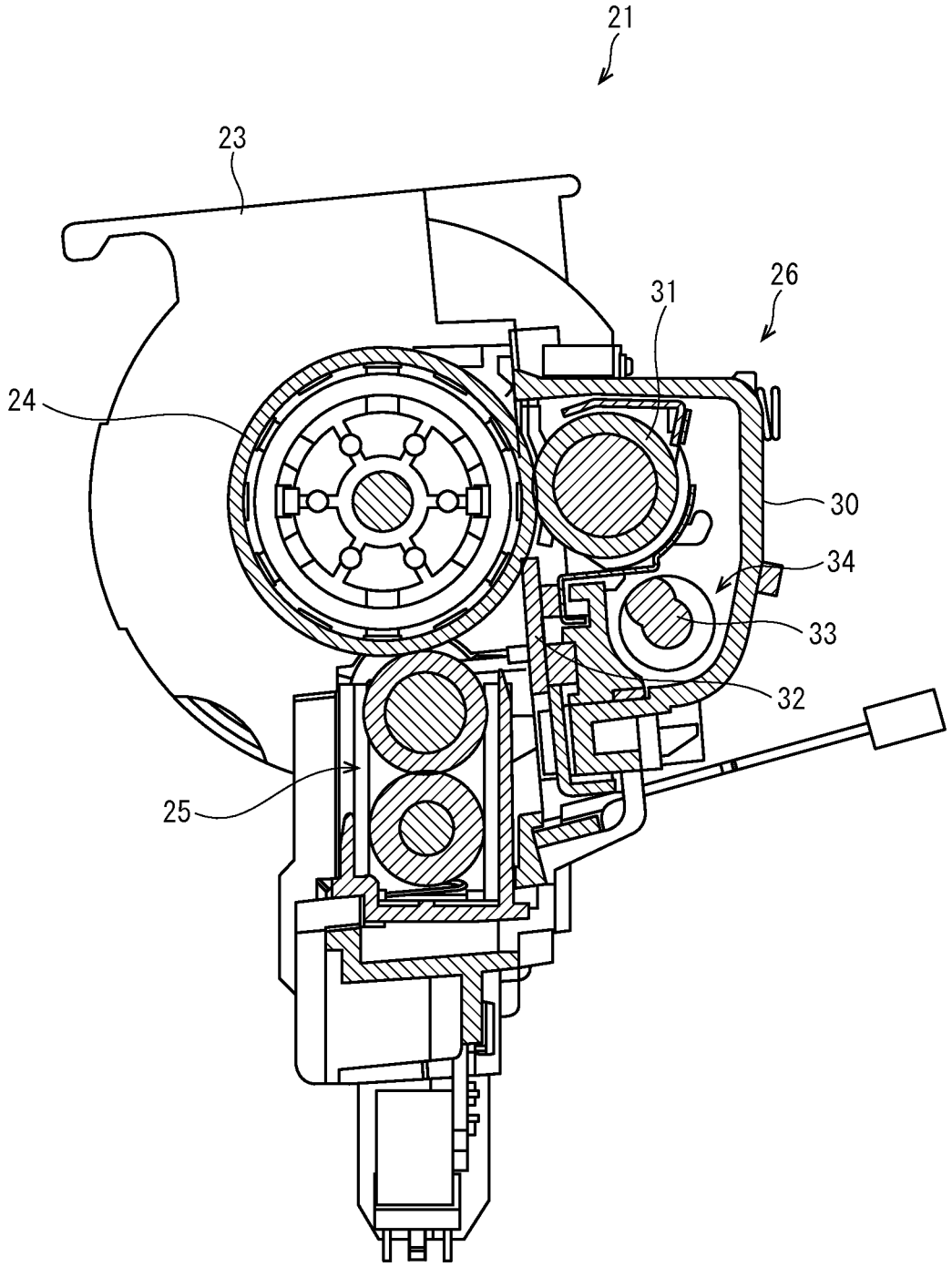
FIG. 3 is a sectional view of a drum unit of the color printer according to the embodiment of the present disclosure.
Figure 4:
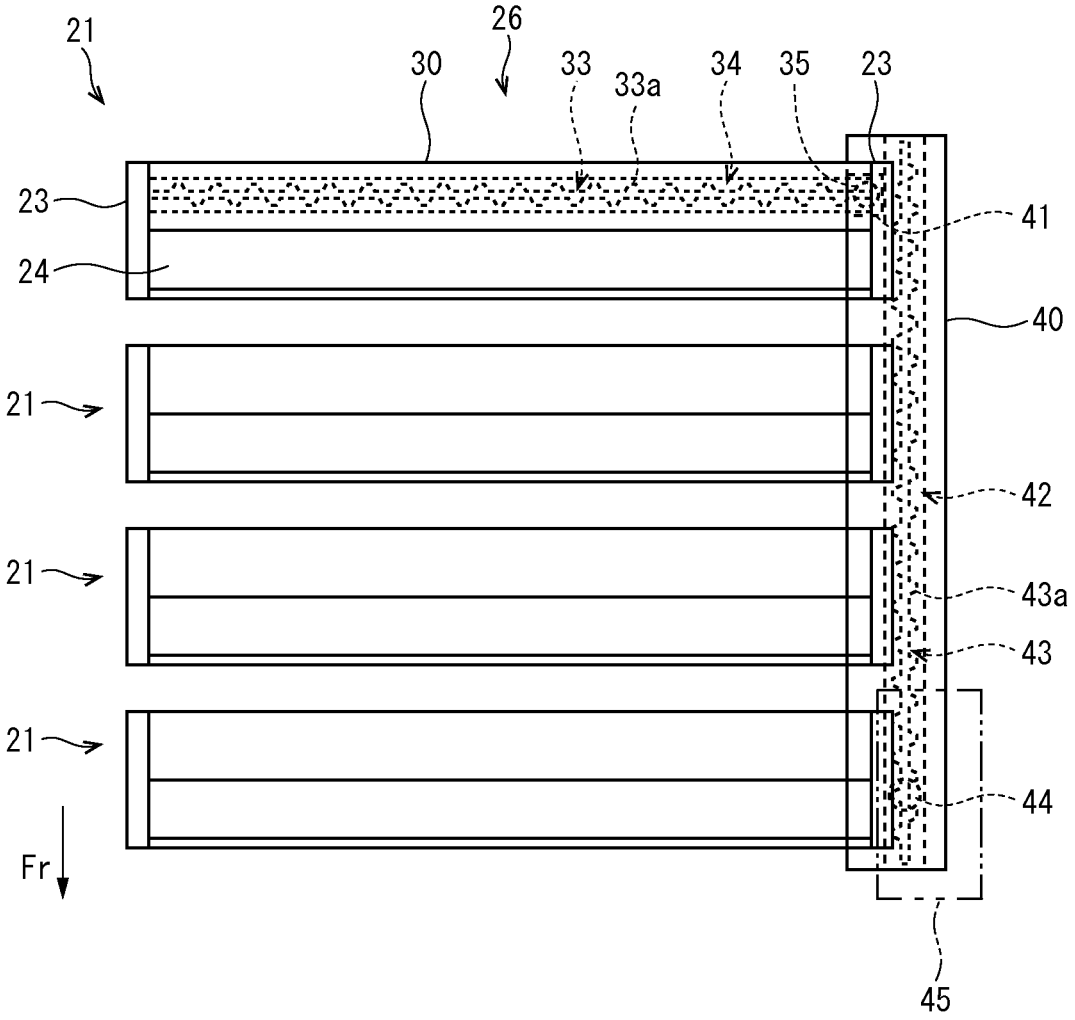
FIG. 4 is a plan view schematically showing the drum unit and a waste toner conveying device in the color printer according to the embodiment of the present disclosure.

First, with reference to FIGS. 1 to 4, the entire structure of the color printer 1 will be descried. FIG. 1 is a perspective view showing the color printer 1. FIG. 2 is a sectional view schematically showing the inside structure of the color printer 1. FIG. 3 is a sectional view showing a drum unit 21. FIG. 4 is a plan view schematically showing the drum unit 21 and a waste toner conveying device 40.

As shown in FIG. 1, the color printer 1 includes an apparatus main body 2 that constitutes main appearance, a sheet feeding cartridge 3 arranged in a lower part of the apparatus main body 2, a manual bypass tray 4 arranged in a front face of the apparatus main body 2, and an ejected sheet tray 5 arranged in an upper face of the apparatus main body 2.

As shown in FIG. 2, the color printer 1 includes a sheet feeding part 11, an image forming part 13, a second transfer nip part 14, a fixing device 15 and a waste toner collecting mechanism 16 inside the apparatus main body 2. The sheet feeding part 11 feeds a sheet stored in the sheet feeding cartridge 3 to a conveyance path 10. The image forming part 13 first-transfers a toner image onto an intermediate transfer belt 12. The second transfer nip part 14 second-transfers the first-transferred toner image onto the sheet. The fixing device 15 fixes the second-transferred toner image to the sheet. The waste toner collecting mechanism 16 collects a toner (a waste toner) that is not first-transferred.

The intermediate transfer belt 12 is arranged horizontally and wound around a driving roller 12*a* and a tension roller 12*b*. The intermediate transfer belt 12 is rotated in a predetermined direction (refer to an arrow shown in FIG. 2) by driving and rotating the driving roller 12*a* with a driving motor (not shown).

The image forming part 13 forms an image by replenishment toners (developers) of four colors (yellow, magenta, cyan, and black) contained in four toner containers 20. The image forming part 13 is provided with four drum units 21 respectively having photosensitive drums 24 as an image carrier, and exposure devices 22 irradiating the surface of the photosensitive drums 24 with laser light (refer to an arrow P shown in FIG. 2).

The four toner containers 20 are arranged at a lower side of the ejected sheet tray 5. The four toner containers 20 are attachably/detachably provided inside the apparatus main body 2 individually.

As shown in FIGS. 2 to 4, the four drum units 21 are arranged at a lower side of the intermediate transfer belt 12 in parallel in forward and backward directions. Each drum unit 21 has the photosensitive drum 24, a charger 25, and a cleaning unit 26. The photosensitive drum 24 is rotatably supported by a pair of supporting frames 23 arranged at both sides in an axial direction. The charger 25 electrically charges the surface of the photosensitive drum 24 to given potential. The cleaning unit 26 eliminates the waste toner remained on the surface of the photosensitive drum 24.

Each photosensitive drum 24 has an amorphous silicon photosensitive layer around an outer circumference face of a drum blank tube made of electroconductive material, such as aluminum. Around each photosensitive drum 24, the above-mentioned charger 25, a development device 27, a first-transferring roller 28 and the above-mentioned cleaning unit 26 are arranged in order of first-transferring process.

Image forming process by the color printer 1 will be described. When the power is supplied to the color printer 1, the color printer 1 initializes various parameters, such as temperature determination of the fixing device 15. In the color printer 1, when image data is inputted and a printing start is directed from a personal computer or the like connected with the color printer 1, image forming operation is carried out as follows.

Each exposure device 22 carries out exposure corresponding to the image data onto the surface of each photosensitive drum 24 electrically charged by each charger 25 to form an electrostatic latent image. Each development device 27 develops the electrostatic latent image to the toner image by each color toner supplied from each toner container 20.

The intermediate transferring belt 12 sequentially carries each color of the toner image first-transferred by each first-transferring roller 28 to which bias is applied. On the intermediate transferring belt 12, a full color toner image is formed. On the other hand, the sheet fed from the sheet feeding cartridge 3 (or the manual bypass tray 4) by the sheet feeding part 11 is conveyed to the second transfer nip part 14 in the conveyance path 10. The second transfer nip part 14 second-transfers the full color toner image onto the sheet by applied bias. This sheet is fixing-processed by the fixing device 15. After that, the sheet is ejected onto the ejected sheet tray 5. The toner (waste toner) remained on each photosensitive drum 24 is eliminated by the cleaning unit 26.

Next, with reference to FIGS. 3 and 4, the cleaning unit 26 of each drum unit 21 will be described. Since four cleaning units 26 have the similar configuration to each other, in the following, one cleaning unit 26 will be described.

The cleaning unit 26 is provided with a casing 30, a cleaning roller 31, a cleaning blade 32 and a first screw 33. The cleaning roller 31 and cleaning blade 32 come into slidably contact with the surface of the photosensitive drum 24 inside the casing 30. The first screw 33 conveys the waste toner in the casing 30.

The casing 30 is extended in an axial direction of the photosensitive drum 24. The casing 30 is formed in a roughly box-like shape opened at the photosensitive drum 24's side. In a lower part of the casing 30, a first conveyance channel 34 is extended in an axial direction. In a bottom face of a right end part of the first conveyance channel 34, a first delivery port 35 is opened. To the first delivery port 35, the waste toner conveying device 40 mentioned below is connected.

Both end parts in an axial direction of the cleaning roller 31 are rotatably supported by an upper part of the casing 30. A part of a circumference face of the cleaning roller 31 is exposed from an opening part of the casing 30 and comes into slidably contact with the surface of the photosensitive drum 24. The cleaning roller 31 is driven by the driving motor (not shown) so as to rotate in an opposite direction to the photosensitive drum 24. The cleaning roller 31 glides the surface of the photosensitive drum 24 after the toner image is first-transferred. Thereby, the waste toner adhered on the surface of the photosensitive drum 24 is eliminated.

The cleaning blade 32 is made, for example, of polyurethane rubber. The cleaning blade 32 is fixed by the lower part of the casing 30. An upper part of the cleaning blade 32 is a free end. The upper part of the cleaning blade 32 is pressured to the photosensitive drum 24 by own elastic force. The cleaning blade 32 comes into contact with the photosensitive drum 24 in a counter direction to a rotating direction of the photosensitive drum 24. The cleaning blade 32 scrapes the waste toner and others on the surface of the photosensitive drum 24.

In order to pressure the cleaning blade 32 to the photosensitive drum 24 by a predetermined pressure force, a biasing part may be provided.

The first screw 33 consists of a rotation shaft part and a helical screw blade 33*a*. The screw blade 33*a* is fixed so as to protrude in a radial direction from a circumference face of the rotation shaft part. The first screw 33 is arranged in the first conveyance channel 34 of the casing 30. Both end parts in an axial direction of the first screw 33 are rotatably supported by the casing 30. The first screw 33 is driven and rotated by the driving motor (not shown).

As shown in FIG. 4, the waste toner conveyance device 40 is extended over the four cleaning units 26 arranged in parallel in the forward and backward directions. In the waste toner conveyance device 40, four unit connecting parts 41 are arranged at regular intervals and connected to the first delivery ports 35 of the respective cleaning units 26. In a lower part of the waste toner conveyance device 40, a second conveyance channel 42 is extended in the forward and backward directions so as to join the four unit connecting parts 41.

Similarly to the first screw 33, in the second conveyance channel 42, a second screw 43 having a helical screw blade 43*a* is arranged. Both end parts in an axial direction of the second screw 43 are rotatably supported by an inner wall of the second conveyance channel 42. The second screw 43 is driven and rotated by the driving motor (not shown). In a bottom face of a front end part of the second conveyance channel 42, a second delivery port 44 is opened. To the second delivery port 44, a waste toner case 45 of the waste toner collecting mechanism 16 mentioned below is connected.

Now, conveyance of the waste toner in one cleaning unit 26 will be described.

The waste toner eliminated from the photosensitive drum 24 by the cleaning unit 26 mentioned above falls down to the first conveyance channel 34 of the casing 30. The waste toner collected in first conveyance channel 34 is conveyed to the first delivery port 35 by the rotation of the first screw 33. The waste toner is flowed into the second conveyance channel 42 through the unit connecting part 41 connected to the first delivery port 35. The waste toner collected in the second conveyance channel 42 is conveyed to the second delivery port 44 by the rotation of the second screw 43. The waste toner is collected in the waste toner case 45 of the waste toner collecting mechanism 16.

Figure 5:
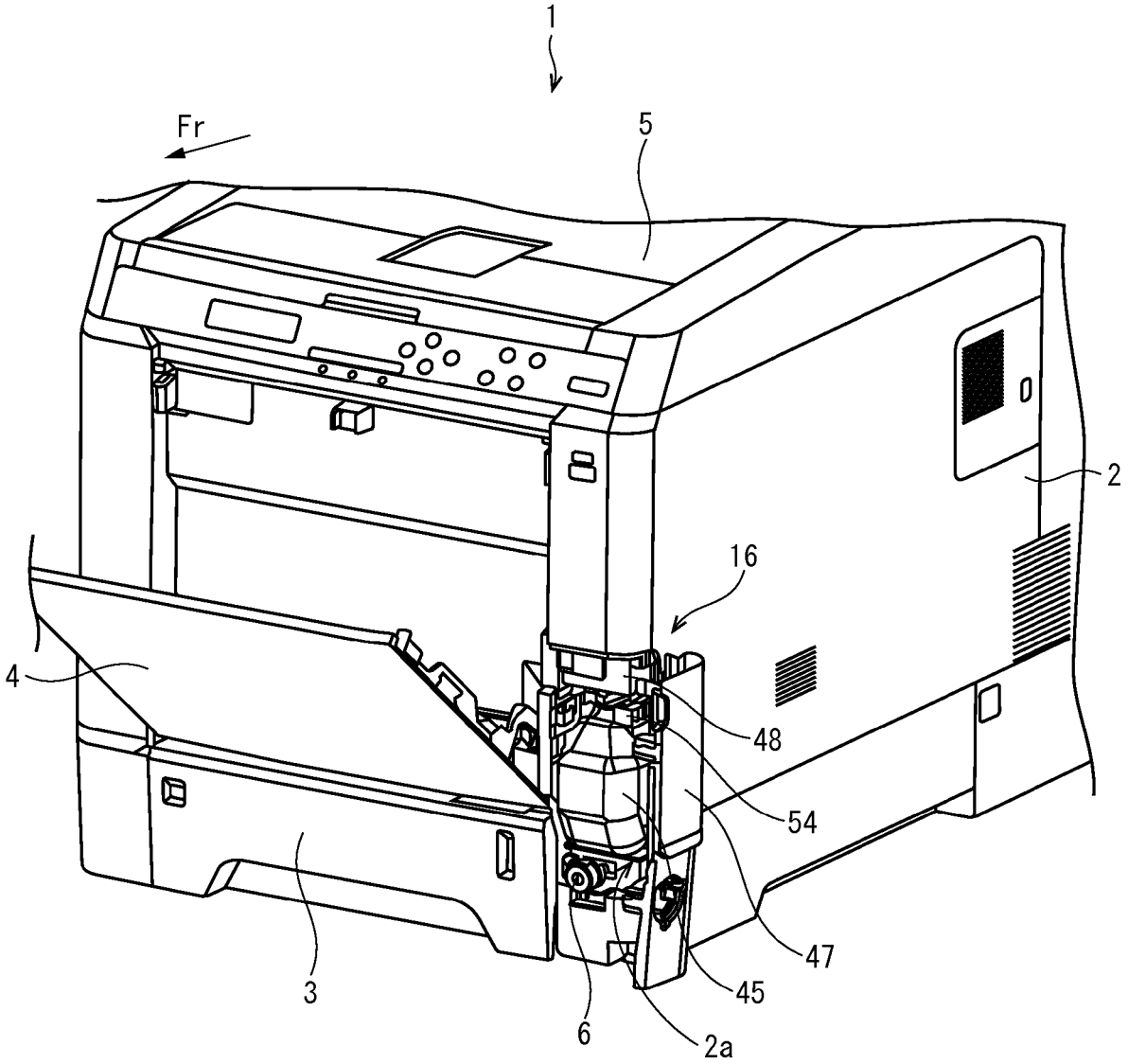
FIG. 5 is a perspective view showing a waste toner collecting mechanism in a condition, in which a waste toner case is attached, in the color printer according to the embodiment of the present disclosure.
Figure 6:
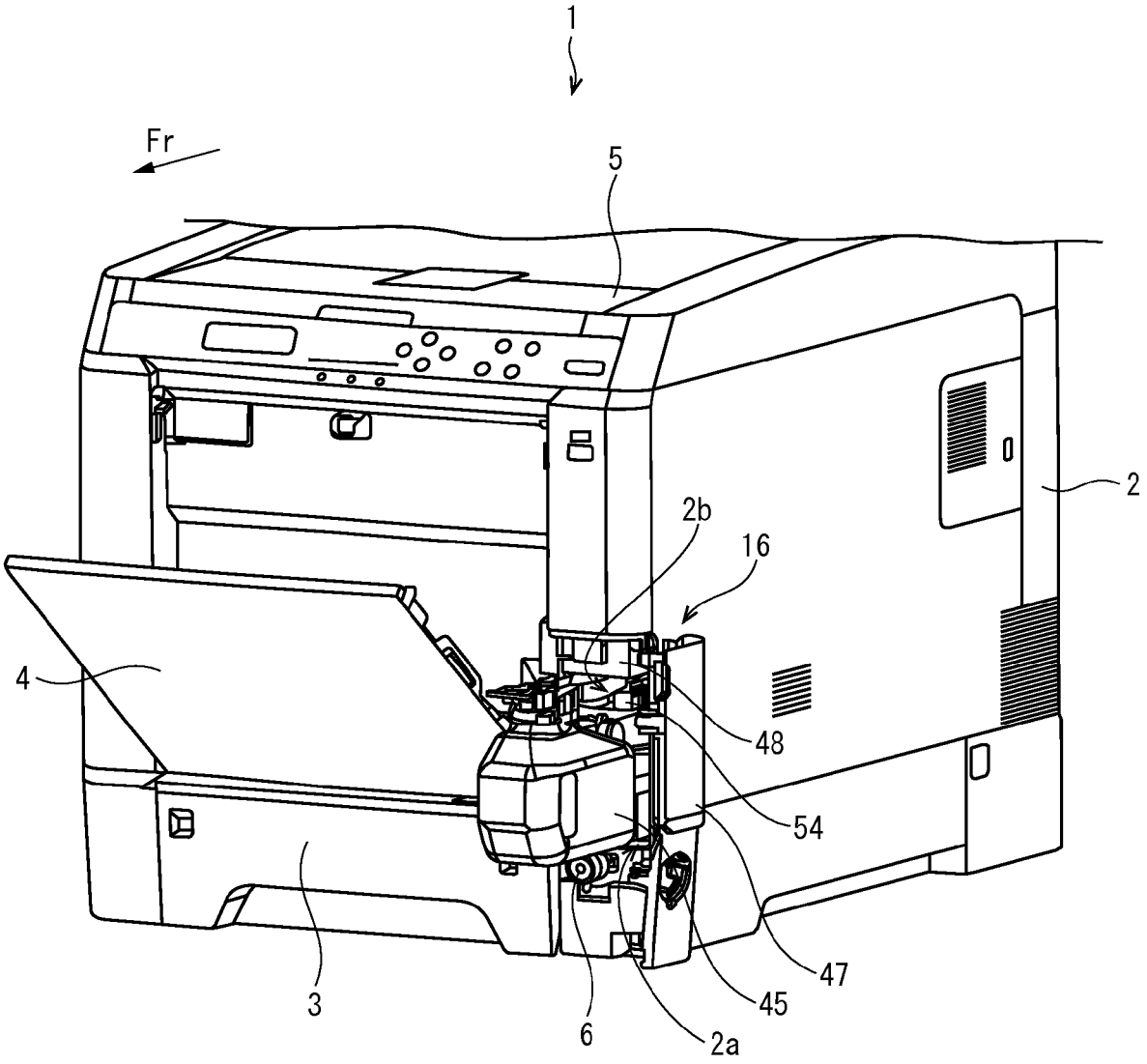
FIG. 6 is a perspective view showing a waste toner collecting mechanism in another condition, in which a waste toner case is detached, in the color printer according to the embodiment of the present disclosure.
Figure 7:
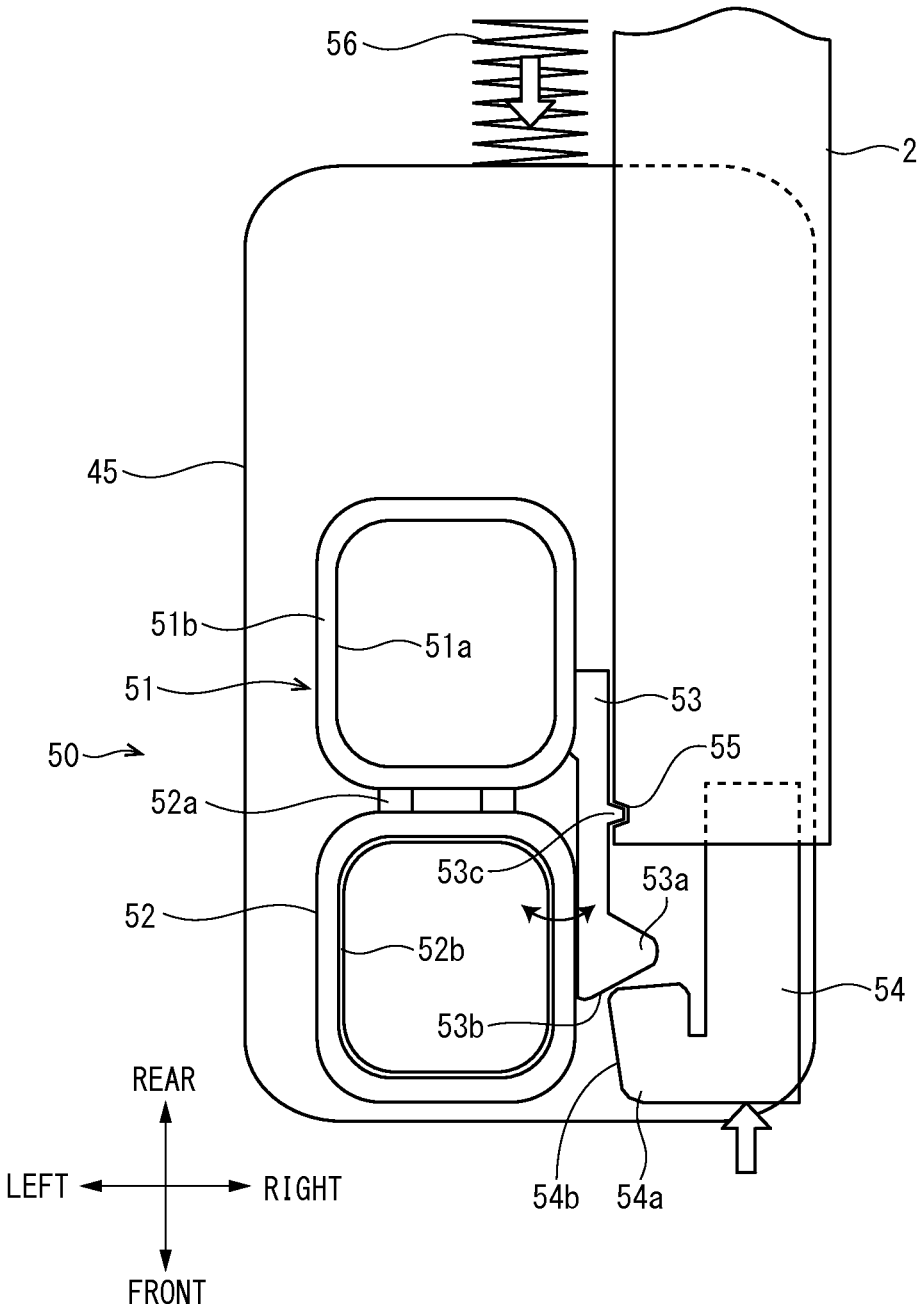
FIG. 7 is a plan view schematically showing the color printer in a condition, in which the waste toner case is attached to an installation space, according to the embodiment of the present disclosure.
Figure 8:
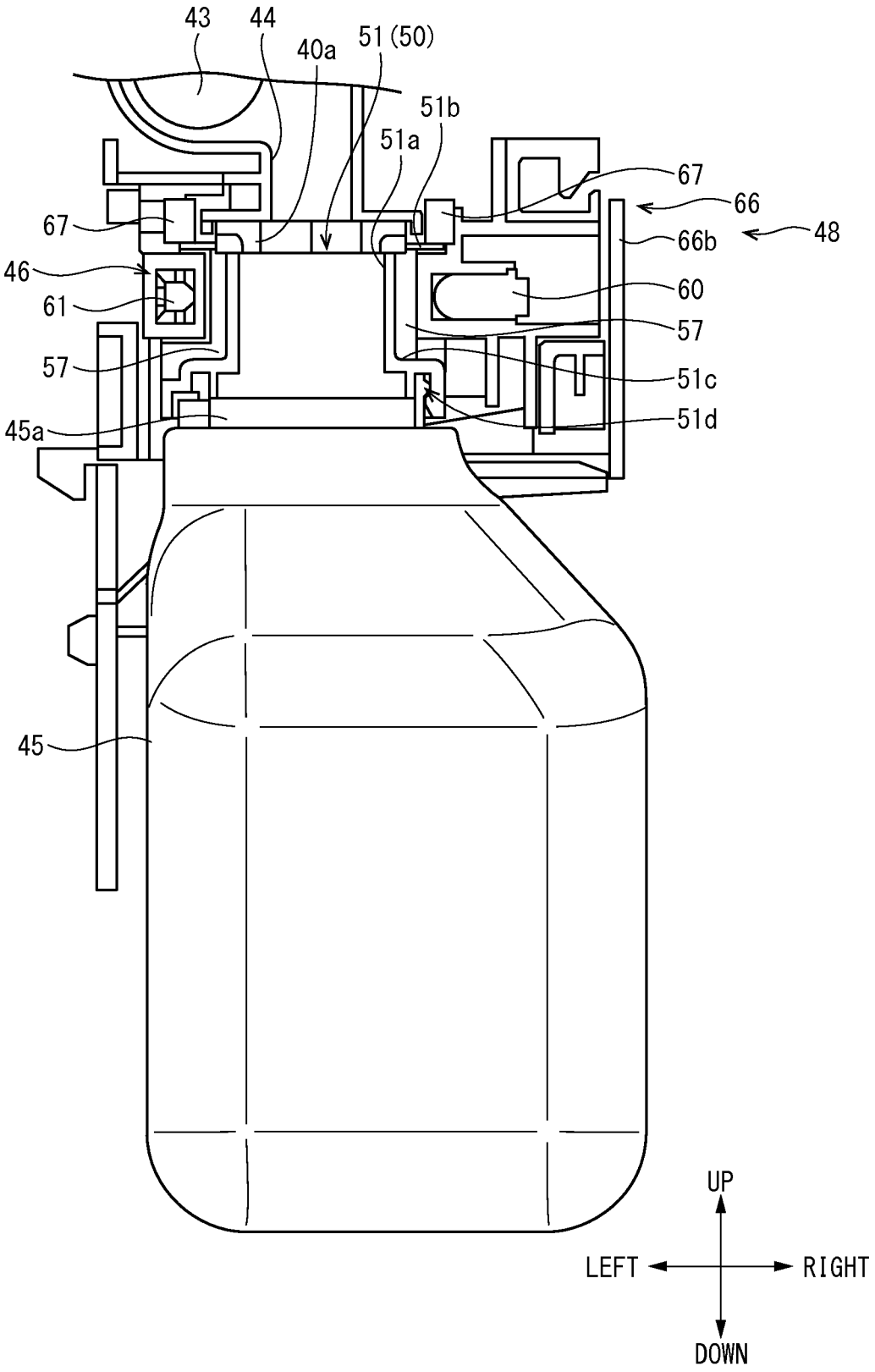
FIG. 8 is a partial sectional view showing the color printer in the condition, in which the waste toner case is attached to the installation space, according to the embodiment of the present disclosure.
Figure 9:
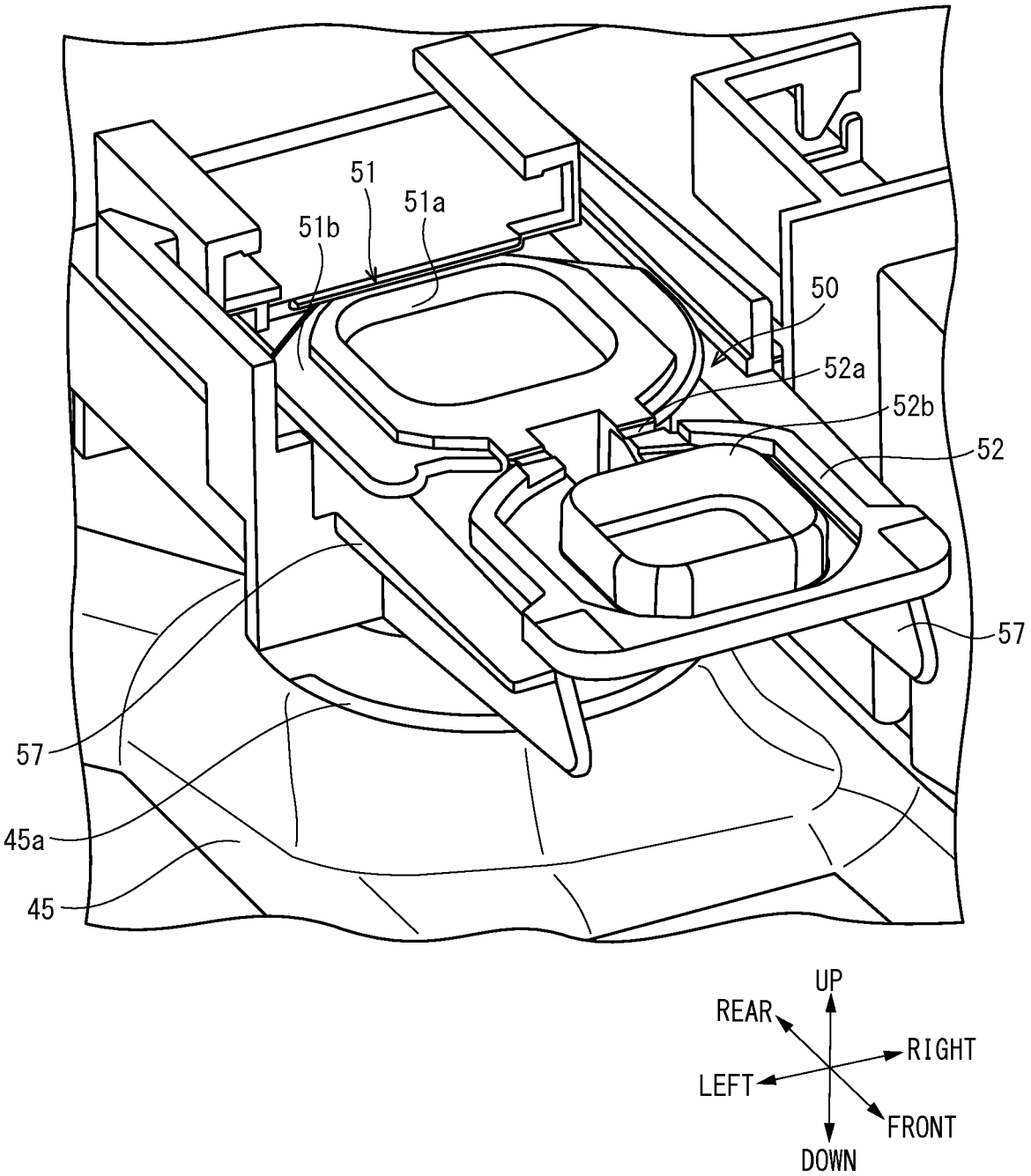
FIG. 9 is a perspective view showing a cap of the waste toner case in the color printer according to the embodiment of the present disclosure.
Figure 10:
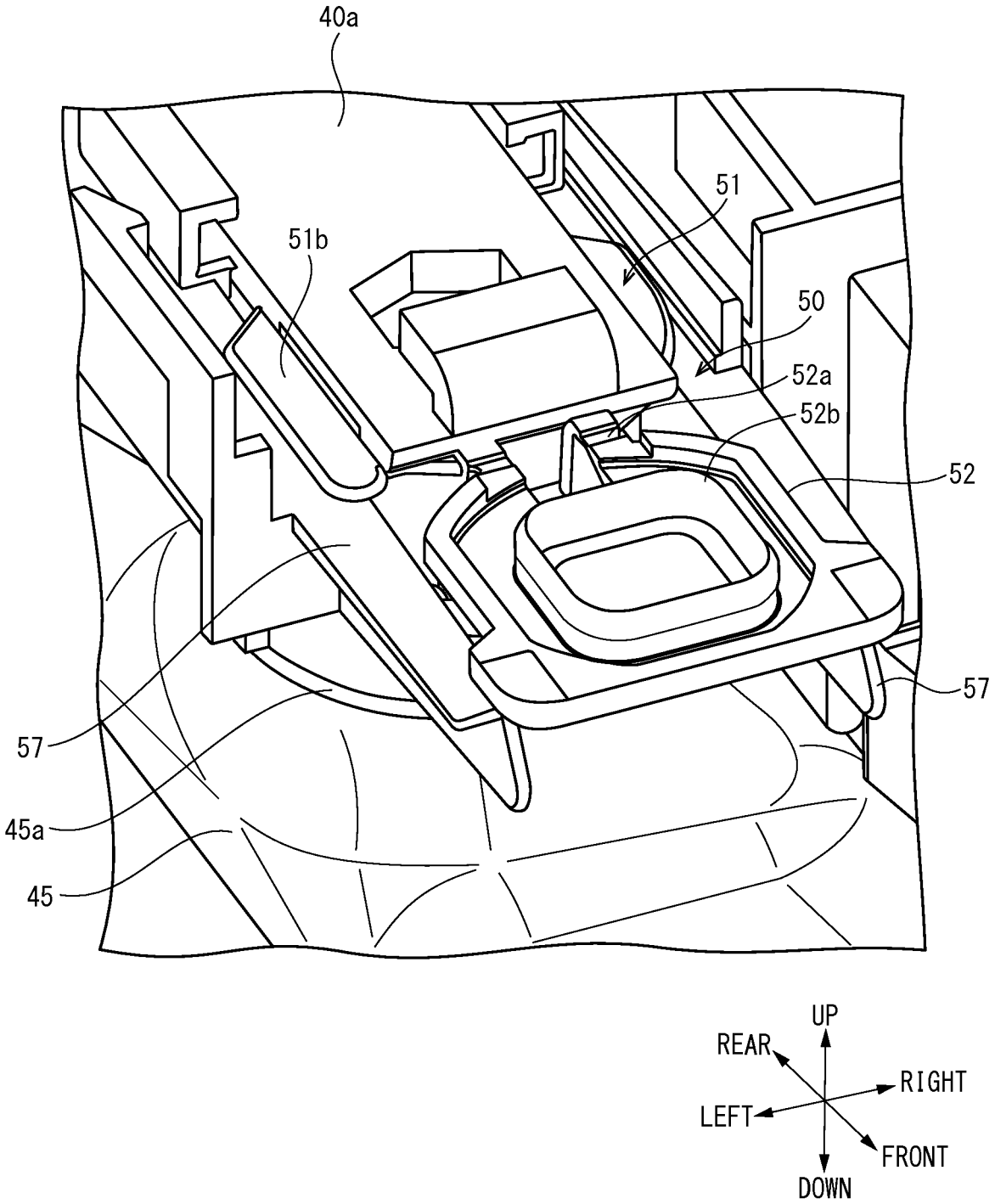
FIG. 10 is a perspective view showing the cap and a main body side seal of the waste toner case in the color printer according to the embodiment of the present disclosure.

Next, with reference to FIGS. 5 to 16, the waste toner collecting mechanism 16 will be described in detail. FIG. 5 is a perspective view showing the waste toner collecting mechanism 16 in a condition, in which the waste toner case 45 is attached. FIG. 6 is a perspective view showing the waste toner collecting mechanism 16 in another condition, in which the waste toner case 45 is detached. FIG. 7 is a plan view schematically showing the waste toner case 45 in a condition of being attached to an installation space 2*b*. FIG. 8 is a partial sectional view showing the waste toner case 45. FIG. 9 is a perspective view showing a cap 50 of the waste toner case 45. FIG. 10 is a perspective view showing the cap 50 and a main body side seal 40*a*. The following description is based on a state where a cover 47 is closed.

As shown in FIGS. 5 to 10, the waste toner collecting mechanism 16 is provided with the waste toner case 45, an optical sensor 46, the cover 47, a shading member 48 and an interlocking device 49. The waste toner case 45 collects the waste toner ejected from the image forming apparatus 13. The optical sensor 46 detects whether or not the waste toner case 45 is filled with the waste toner. The cover 47 closes an opening part 2*a* of the apparatus main body 2. The shading member 48 is arranged between the cover 47 and optical sensor 46 to cover the optical sensor 46 in a state where the cover 47 is closed. The interlocking device 49 interlocks with opening operation of the cover 47 to withdraw the shading member 48 from an attaching/detaching path for the waste toner case 45 (refer to FIG. 16 and other figures).

As shown in FIGS. 5 and 6, the waste toner collecting mechanism 16 is arranged in a right lower part at the front side of the apparatus main body 2 (at the right side of the manual tray 4). In the right lower part at the front side of the apparatus main body 2, the opening part 2*a* is formed. The installation space 2*b* is arranged backward from the opening part 2*a*. In the installation space 2*b*, the waste toner case 45 is attachably/detachably provided. In the opening part 2*a*, the cover 47 is turnably supported as mentioned below in detail. At the lower side of the opening part 2*a* (at the right side of the sheet feeding cartridge 3), a power switch 6 is provided.

As shown in FIGS. 6 to 8, the waste toner case 45 is made of synthetic resin or the like and formed in a roughly rectangular parallelepiped shape having rounded corners. The waste toner case 45 has an inside space accumulating the waste toner. In detail, the waste toner case 45 is formed in a roughly rectangular shape elongated vertically in a front view and in a roughly rectangular shape elongated horizontally in a side view. A part at a slightly right side in an upper part of the waste toner case 45 is formed so as to be tapered upward. In a tapered upper end part of the waste toner case 45, a cylinder-like case opening 45*a* is formed.

To the case opening 45*a*, the cap 50 is fitted from the upper side. At least the case opening 45*a* and cap 50 are made of translucent synthetic resin or the like.

As shown in FIGS. 7 to 10, the cap 50 has a roughly cylinder-like cap main body 51, a lid part 52 and a roughly plate-like lock piece 53. In the cap main body 51, a collecting port 51*a* communicating with the case opening 45*a* is formed. The lid part 52 is configured so as to open/close the collecting port 51*a* of the cap main body 51. The lock piece 53 is extended forward from a front face at the right side of the cap main body 51.

In the cap main body 51, a flange part 51*b* protruding in a radial direction is formed. The flange part 51*b* is formed at a position at a slightly lower side from an opening face at the upper side of the collecting port 51*a*. In a lower part of the cap main body 51, a difference part 51*c* is provided. The cap main body 51 is formed so that the lower part has a diameter larger than an upper part (refer to FIG. 8). In a lower end part of the cap main body 51, an annular groove part 51*d* fitting to an upper edge of the case opening 45*a* is formed (refer to FIG. 8).

The collecting port 51*a* is formed in a roughly rectangular shape in a planar view. Through the collecting port 51*a*, the image forming part 13 and the inside of the waste toner case 45 are communicated with each other. In detail, the collecting port 51*a* is connected to the second delivery port 44 of the above-mentioned waste toner conveying device 40 via the main body side seal 40*a* (refer to FIGS. 8 and 10). Thereby, the waste toner conveyed by the cleaning unit 26 and waste toner conveying device 40 is accumulated in the waste toner case 45 through the collecting port 51*a*. In the main body side seal 40*a*, an opening communicating with the collecting port 51*a* is formed.

As shown in FIGS. 7 and 9, the lid part 52 is connected to the cap main body 51 via two hinge parts 52*a* extended forward from a front end part of the cap main body 51. The lid part 52 turns around the hinge parts 52*a* by 180 degrees. In the lid part 52, a rectangular annular positioning part 52*b* is protruded. The positioning part 52*b* is slightly inserted in the collecting port 51*a* when the collecting port 51*a* is closed.

As shown in FIG. 7, the lock piece 53 is connected to the cap main body 51 just below the flange part 51*b*. The lock piece 53 is formed flexibly in left and right direction around the connected portion. In a front end part of the lock piece 53, a position regulating part 53*a* is formed in a triangle shape in a planar view. In the position regulating part 53*a*, a regulating side inclined face 53*b* is formed so as to be inclined rightward from a front end to the backward direction. At the back side of the position regulating part 53*a*, a protrusion part 53*c* protruded in the right direction is formed.

In a right side wall of the apparatus main body 2, a lever 54 is supported slidably in the forward and backward directions. The lever 54 is arranged in a state of being usually biased forward by a biasing part (not shown), such as a spring. In a front end part of the lever 54, a hook-like pressuring part 54*a* is formed. The pressuring part 54*a* is folded to a left backward direction so as to come into contact with the regulating side inclined face 53*b* of the position regulating part 53*a*. In the pressuring part 54*a*, a lever side inclined face 54*b* is formed so as to be inclined leftward from a front end to the backward direction.

In a right inner wall of the installation space 2*b* of the apparatus main body 2, a depression part 55 is formed. Into the depression part 55, the protrusion part 53*c* of the lock piece 53 is fitted. In a rear inner wall of the installation space 2*b*, a coil spring 56 is provided to bias the waste toner case 45 forward.

Furthermore, as shown in FIGS. 9 and 10, in an upper part of the installation space 2*b*, a pair of left and right guide frames 57 having a roughly L-shape in a front view are provided. Between the pair of the guide frames 57, the cap main body 51 of the waste toner case 45 is arranged so as to be interposed. In detail, to vertical side walls of the pair of the guide frames 57, an upper part (an upper side from the difference part 51*c*) of the cap main body 51 contacts. With horizontal upper faces of the pair of the guide frames 57, a lower face of the flange part 51*b* of the cap 50 comes into contact (refer to FIG. 8).

Now, with reference to FIG. 7, attachment and detachment of the waste toner case 45 to the installation space 2*b* will be described. Herein, the cover 47 (the opening part 2*a*) has been opened.

First, in a case of attaching the waste toner case 45 to the installation space 2*b*, a user inserts the waste toner case 45 into the installation space 2*b* from the opening part 2*a* in a predetermined direction. The lid part 52 of the cap 50 is in a state of having been turned 180 degrees and opening the collecting port 51*a*. At this time, the flange part 51*b* of the cap 50 is engaged with the upper faces of the pair of the guide frames 57. The waste toner case 45 is guided by the pair of the guide frames 57 to slide in the installation space 2*b*.

After the slide of the waste toner case 45 advances, the protrusion part 53*c* of the lock piece 53 gets over the pressuring part 54*a* (the lever side inclined face 54*b*) of the lever 54. Subsequently, the position regulating part 53*a* of the lock piece 53 begins to come into slidably contact with the lever side inclined face 54*b* of the pressuring part 54*a*. The lock piece 53 flexes in the left direction.

After the slide of the waste toner case 45 further advances, the position regulating part 53*a* gets over the pressuring part 54*a*. The lock piece 53 is turned to a previous position by own resilience. The regulating side inclined face 53*b* of the position regulating part 53*a* comes into contact with a rear end face of the pressuring part 54*a* and the protrusion part 53*c* of the lock piece 53 is fitted to the depression part 55. At this time, the waste toner case 45 is biased forward by the coil spring 56. Therefore, the regulating side inclined face 53*b* of the position regulating part 53*a* is pressured to the rear end face of the pressuring part 54*a* and the protrusion part 53*c* is pressured to an inner circumference face at the front side of the depression part 55. Thereby, the lock piece 53 is stopped in an engaged state with the lever 54 and others and a state of the waste toner case 45 being attached to the installation space 2*b* is maintained.

On the other hand, in another case of detaching (withdrawing) the waste toner case 45 from the installation space 2*b*, the user presses the lever 54 backward. Then, the pressuring part 54*a* begins to come into slidable contact with the regulating side inclined face 53*b* of the position regulating part 53*a*. The lock piece 53 flexes in the left direction.

After the press of the lever 54 further advances, the protrusion part 53*c* is extracted from the depression part 55 and the pressuring part 54*a* gets over the position regulating part 53*a*. Thereby, a state of the lock piece 53 being stopped in an engaged state with the lever 54 and others is released. The waste toner case 45 is pushed out forward by a biasing force of the coil spring 56. At this time, a front part of the waste toner case 45 is projected forward from the opening part 2*a*. Therefore, the user can easily detach the waste toner case 45.

As mentioned above, the waste toner case 45 is attachably/detachably provided in the apparatus main body 2 (the installation space 2*b*) from the opening part 2*a*. In the state of the waste toner case 45 being attached to the installation space 2*b*, the second delivery port 44 and collecting port 51*a* are respectively arranged in close contact with front and back surfaces of the main body side seal 40*a*.

Subsequently, as shown in FIG. 8, the optical sensor 46 is a so-called transmissive optical sensor. The optical sensor 46 has a light emission part 60 and a light reception part 61 detecting signal light emitted from the light emission part 60.

The light emission part 60 and light reception part 61 are arranged to face to each other across the upper part of the cap main body 51 of the waste toner case 45 (the upper side from the difference part 51*c*). In detail, the light emission part 60 is supported by a side face of right guide frame 57. The light reception part 61 is supported by a side face of left guide frame 57.

In a case where the waste toner collected in the waste toner case 45 is not yet accumulated by the upper part of the cap main body 51, the signal light emitted from the light emission part 60 is passed through the cap main body 51 and inputted to the light reception part 61. Thereby, a controlling device (not shown) of the color printer 1 can detect that the waste toner case 45 is not filled. On the other hand, in another case where the waste toner is accumulated by the upper part of the cap main body 51, the signal light emitted from the light emission part 60 is obstructed by the accumulated waste toner. Therefore, the light reception part 61 cannot receive the signal light. Thereby, the controlling device can detect that the waste toner case 45 is filled.

Figure 11:
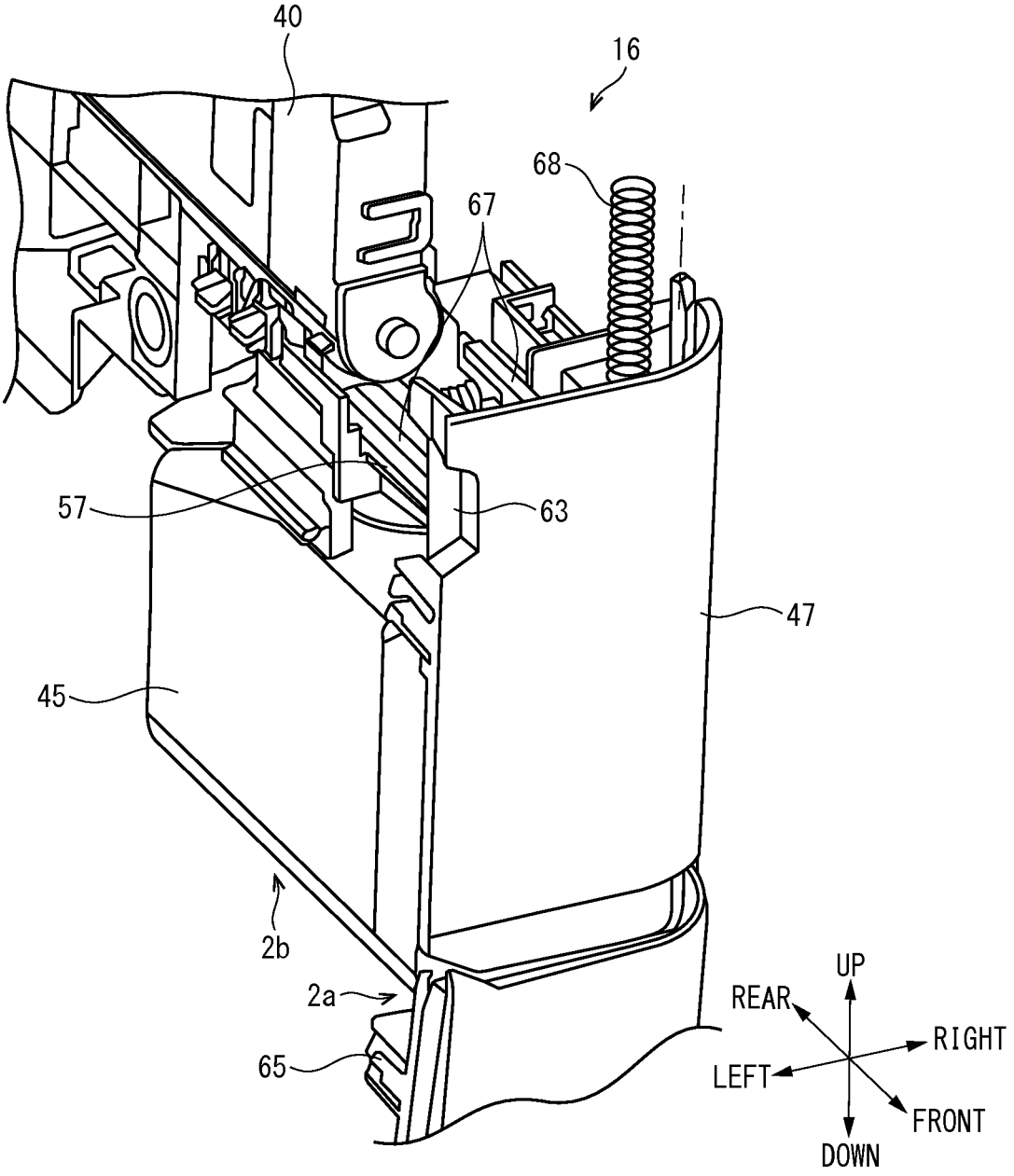
FIG. 11 is a perspective view showing the color printer in a condition, in which a cover is closed, according to the embodiment of the present disclosure, and is used for explanation of action of an interlocking device.
Figure 12:
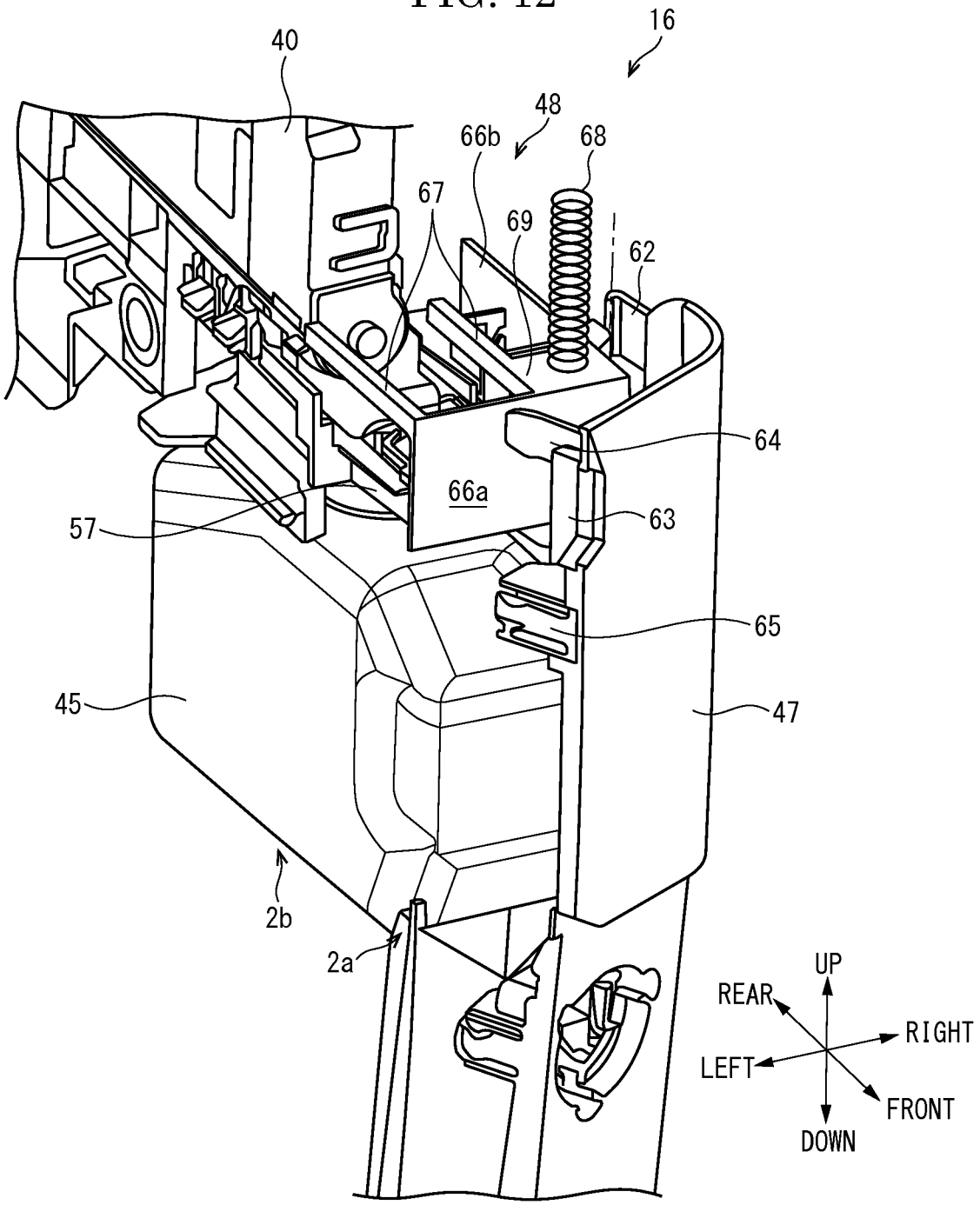
FIG. 12 is a perspective view showing the color printer in another condition in the middle of opening the cover according to the embodiment of the present disclosure, and is used for the explanation of the action of the interlocking device.
Figure 13:
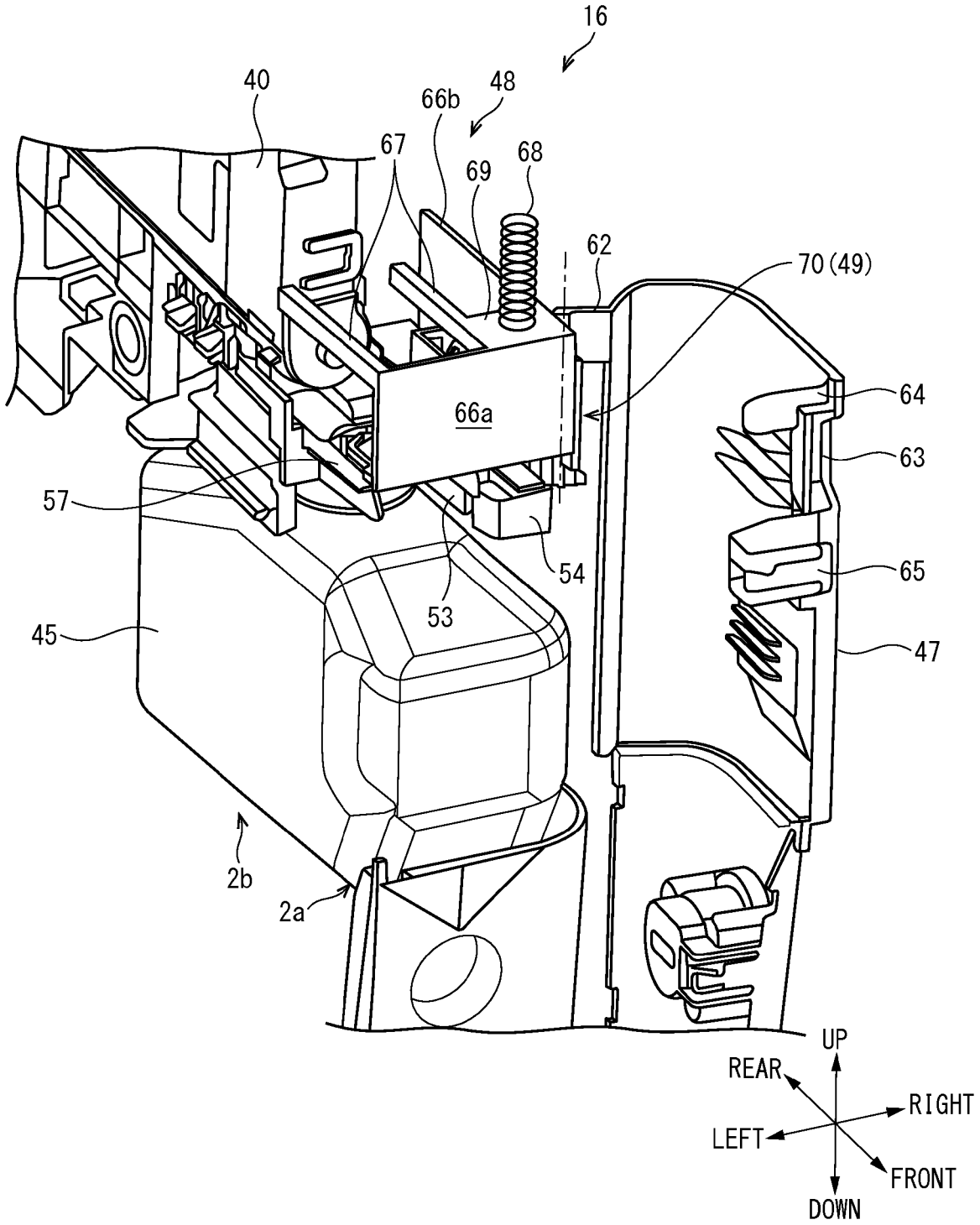
FIG. 13 is a perspective view showing the color printer in a further condition, in which the cover is opened, according to the embodiment of the present disclosure, and is used for the explanation of the action of the interlocking device.

Next, with reference to FIGS. 11 to 13, the cover 47 will be described. FIGS. 11 to 13 are perspective views used for explanation of action of the interlocking device 49. In FIG. 11, a state of closing the cover 47 is illustrated. In FIG. 12, another state in the middle of opening the cover 47 is illustrated. In FIG. 13, a further state of opening the cover 47 is illustrated.

The cover 47 is made of synthetic resin and partly constitutes appearance of the apparatus main body 2 in a state of closing the opening part 2*a*. In detail, the cover 47 is formed by folding in an L-shape in a planar view to constitute right corner of the sheet feeding cartridge 3 and manual tray 4 (refer to FIG. 1). In a right end part of the cover 47, a pair of upper and lower turn supporting parts 62 are provided. The cover 47 is turnably attached to a right edge part of the opening part 2*a*. The cover 47 is turned around turning axes (refer to a dashed line in FIG. 11 and other figures) of the turn supporting parts 62. The cover 47 can open and close the opening part 2*a* (the installation space 2*b*). Incidentally, the cover 47 may be pivotally supported by one end at a left or right side of the opening part 2*a*.

In a left upper end part of the cover 47, a handling part 63 for hooking a finger when the user opens the cover 47 is recessed backward from the front face. In a reverse face (a back face) of the cover 47, a guide piece 64 and a hook part 65 are provided. The guide piece 64 is inserted into a guide hole (not shown) provided at the apparatus main body 2's side, when the cover 47 is closed. The guide piece 64 is protruded backward from an upper part at the back side of the handling part 63. The hook part 65 is stopped in an engaged state with an engaging-stopped part (not shown) provided at the apparatus main body 2's side. The hook part 65 is protruded backward from a lower side at the back side of the handling part 63. In the back face of the cover 47, a plurality of ribs for reinforcement are provided.

Figure 14:
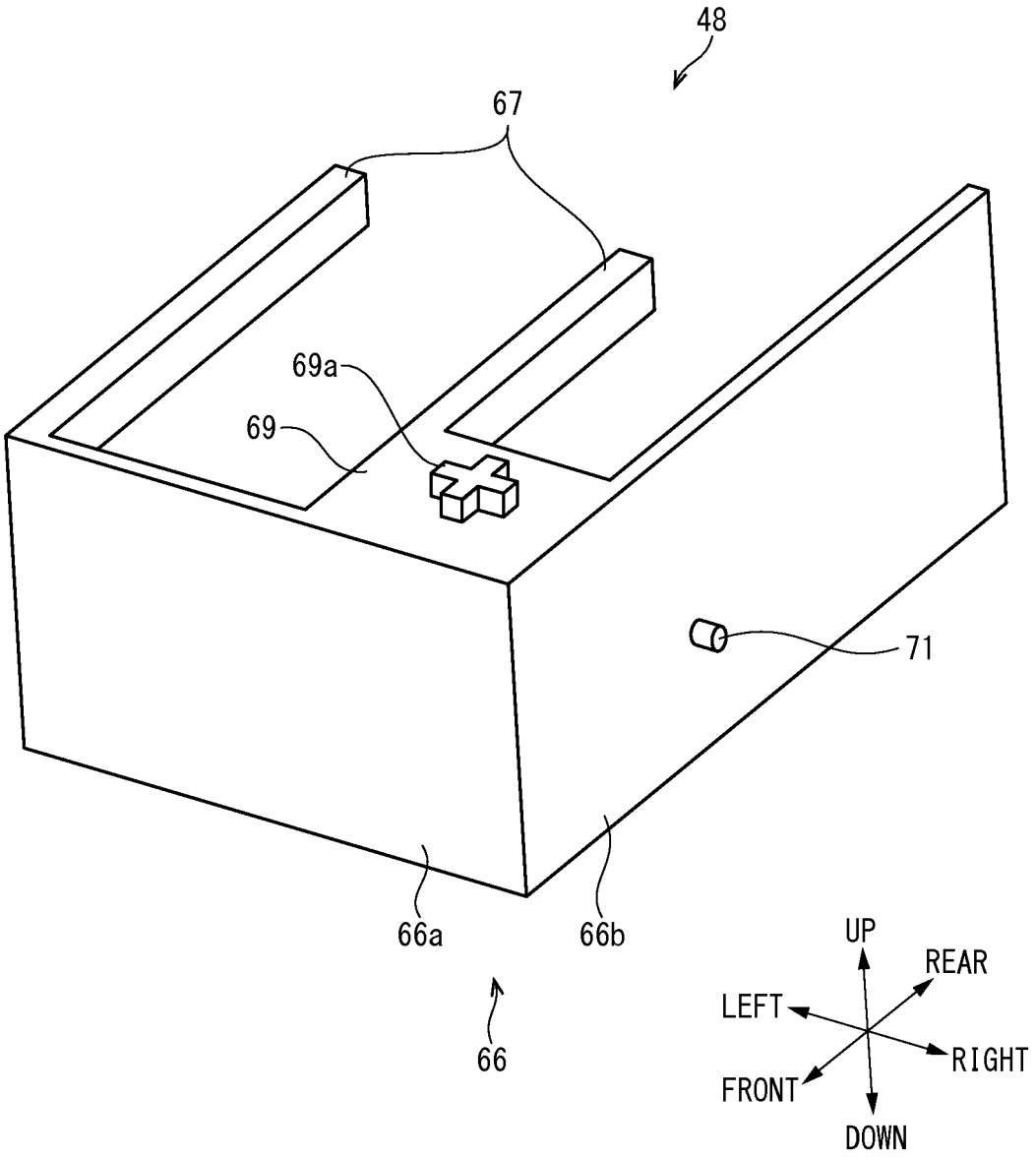
FIG. 14 is a perspective view showing a shading member in the color printer according to the embodiment of the present disclosure.
Figure 15:
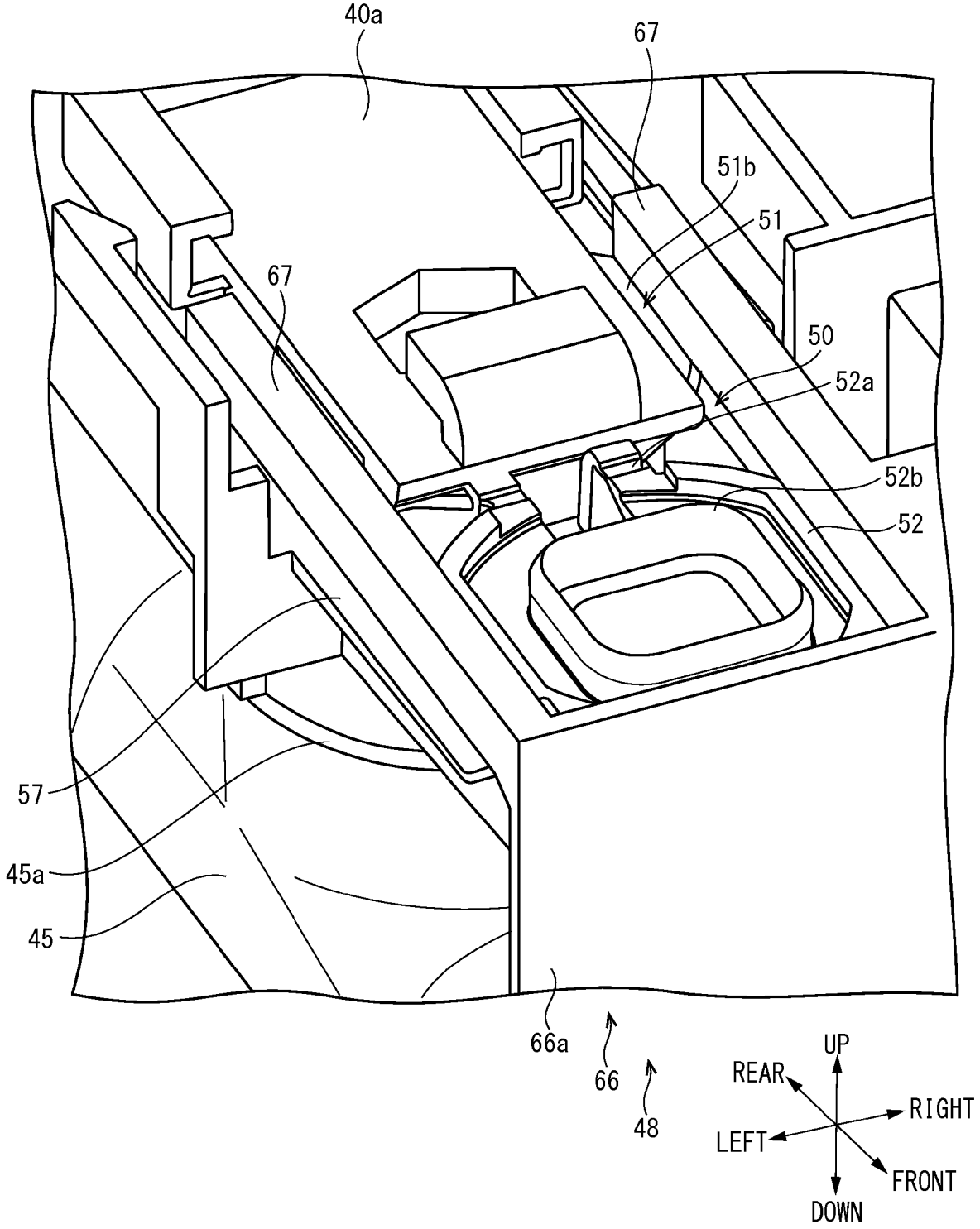
FIG. 15 is a perspective view showing the color printer in a condition, in which arm parts of the shading member hold a flange part of a cap main body, according to the embodiment of the present disclosure.

Next, with reference to FIGS. 12 to 15, the shading member 48 will be described. FIG. 14 is a perspective view showing the shading member 48. In a perspective view of FIG. 15, a condition, in which arm parts 67 hold the flange part 51*b*, is illustrated.

The shading member 48 has two shading plates 66 (66*a*, 66*b*) covering the optical sensor 46, a pair of the arm parts 67 coming into contact with a circumference edge of the collecting port 51*a* in the state of closing the cover 47, and a pressure spring 68 biasing the arm parts 67 to the circumference edge of the collecting port 51*a*.

The two shading plates 66*a*, 66*b* are formed in an L-shape in a planar view so as to constitute a front face and a right side face. In the following description, for convenience, the front face side one is called as a first shading plate 66*a* and the side face side one is called as a second shading plate 66*b*.

The first shading plate 66*a* is arranged between the cover 47 and a front face of the optical sensor 46 in the state of closing the cover 47. The first shading plate 66*a* covers the front side of the optical sensor 46 (refer to FIG. 12). The second shading plate 66*b* is arranged between a right side wall of the apparatus main body 2 and the right guide frame 57 in the state of closing the cover 47. The second shading plate 66*b* covers the right side of the optical sensor 46 (refer to FIG. 8).

The pair of the arm parts 67 are formed so as to have a rectangular section. The pair of the arm parts 67 are extended backward from an upper end of a back face of the first shading plate 66*a*. The pair of the arm parts 67 are formed in equal lengths in the forward and backward directions. The pair of the arm parts 67 are formed shorter than a length in the forward and backward directions of the second shading plate 66*b*. The pair of the arm parts 67 are formed to leave a space in the left and right directions slightly larger than the collecting port 51*a* of the cap 50 (the cap main body 51) mentioned above. A lower face of each arm part 67 comes into contact with an upper face of the flange part 51*b* (refer to FIG. 15).

In a front side area surrounded by the right arm part 67 and shading plates 66*a*, 66*b*, a spring supporting plate 69 supporting a lower end part of the pressure spring 68 is formed. An upper face of the spring supporting plate 69 constitutes a plane in the same level as upper faces of the arm parts 67 and shading plates 66*a*, 66*b*. In a roughly center of the spring supporting plate 69 in a planar view, a spring fitting part 69*a* protruding upward in a cross shape is formed (refer to FIG. 14). The shading plates 66*a*, 66*b*, arm parts 67 and spring supporting plate 69 are formed in a body by synthetic resin or the like.

As shown in FIGS. 12 and 13, the pressure spring 68 is a so-called coil spring. A lower end part of the pressure spring 68 is fixed by fitting to the spring fitting part 69*a*. An upper end part of the pressure spring 68 is fixed to a main body side spring fitting part (not shown) of the apparatus main body 2. Thereby, the pressure spring 68 biases the shading member 48 downward.

In the apparatus main body 2, a plurality of guide rails (not shown) are extended in upward and downward directions. The shading member 48 is configured so as to be guided by the guide rails and to be moved in a space between the cover 47 and opening part 2*a* in parallel with the upward and downward directions.

Figure 16:
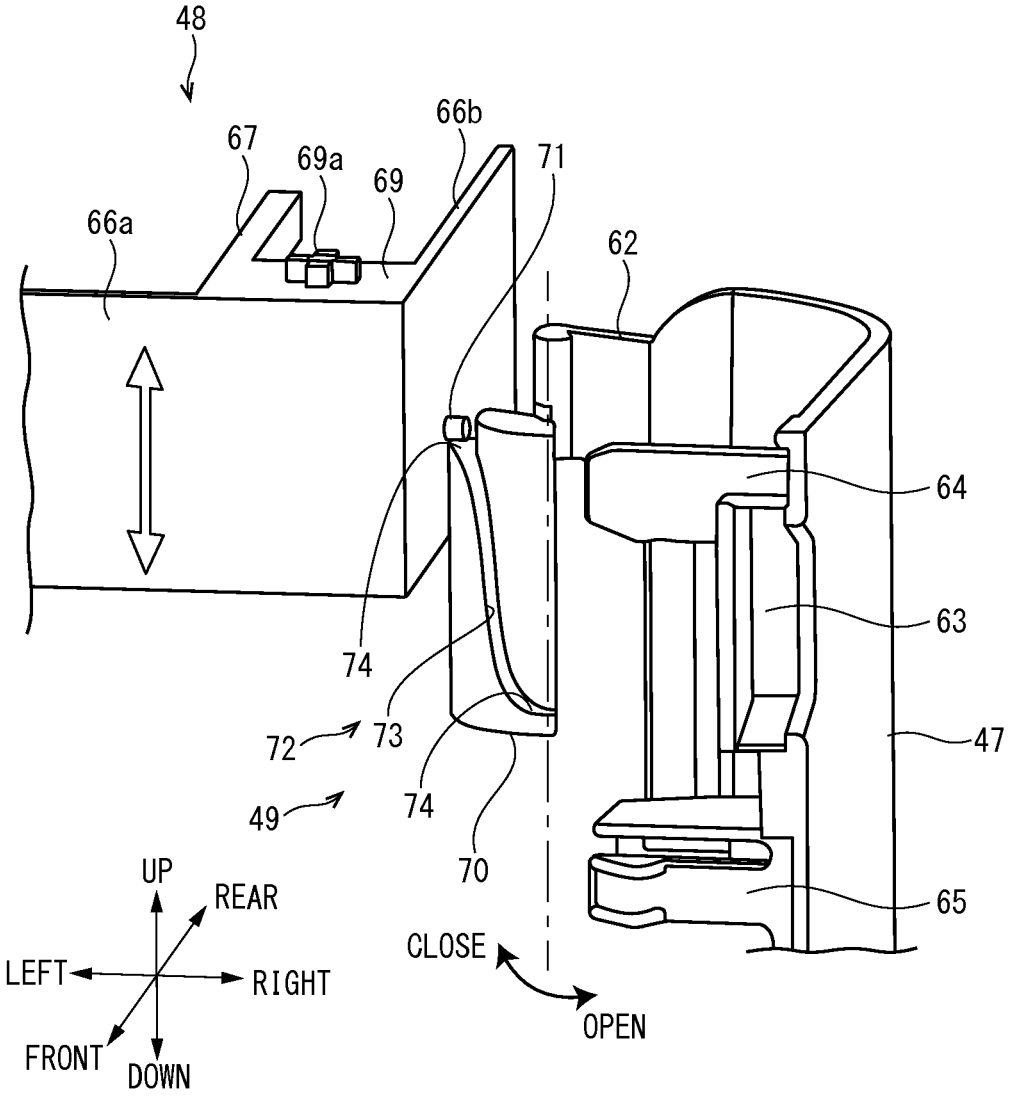
FIG. 16 is a perspective view showing the interlocking device in the color printer according to the embodiment of the present disclosure.

Next, with reference to FIG. 16, the interlocking device 49 will be described. FIG. 16 is a perspective view showing the interlocking device 49.

The interlocking device 49 has a cam 70 provided in a turning shaft of the cover 47 and a cam follower 71 protruded in the shading member 48 so as to come into slidable contact with the cam 70. The cam 70 and cam follower 71 are made of synthetic resin, metal or others.

The cam 70 is a column body having a fan-shaped section, and is fixed to the upper turn supporting part 62 in an upright state. In detail, a center side in an arc of an upper part of the cam 70 is fixed to a lower part of the turn supporting part 62. Thereby, the cam 70 is integrally turned by opening/closing (turning) operation of the cover 47.

In a circumference face at the arc side of the cam 70, a spiral orbit face 72 is formed. The orbit face 72 is formed so as to be extended from an upper end face to a lower end face in the cam 70 and to be recessed from an outermost circumference face to a center side of the arc in the cam 70 by one step. The orbit face 72 has an inclined face 73 inclined upward in a direction of closing the cover 47 and roughly horizontal placed faces 74 formed to respectively continue to an upper end part and a lower end part of the inclined part 73.

The cam follower 71 is a columnar protrusion. The cam follower 71 is protruded to the outside (the right side) at a slightly front side of the second shading plate 66*b* and at a roughly center in the upward and downward directions.

Next, with reference to FIGS. 11 to 13, and 16, work of replacing the waste toner case 45 will be described. Concretely, action of the interlocking device 49 interlocking the opening/closing operation of the cover 47 to move the shading member 48 will be described. In the description, a condition, in which the waste toner case 45 is installed into the installation space 2*b* and the cover 47 is closed, (refer to FIG. 11) is called as an initial condition. In this initial condition, the cam follower 71 comes into contact with the placed face 74 in the lower end part of the orbit face 72. The shading plates 66*a* and 66*b* cover the optical sensor 46.

After the collection of the waste toner to the waste toner case 45 advances, the waste toner case 45 is filled with the waste toner. Then, the signal light emitted from the light emission part 60 of the optical sensor 46 is obstructed and output signal from the light reception part 61 is greatly varied. When the output signal with such a variation is inputted to the controlling device, the controlling device notifies the user by a speaker, a display device or others that the waste toner case 45 is filled.

The user becoming aware that the waste toner case 45 is filled hooks the handling part 63 of the cover 47 by his/her finger and turns the cover 47 to the front side (refer to FIG. 12). At this time, the cover 47 as well as the cam 70 of the interlocking device 49 simultaneously are turned and the cam follower 71 advances on the orbit face 72 so as to come into slidable contact with the orbit face 72 relatively. Thereby, the cam follower 71 is moved upward from the placed face 74 of the lower end part along the inclined face 73. Therefore, the shading member 48 having the cam follower 71 fixed is moved upward against the biasing force of the pressure spring 68. Moreover, when the cover 47 is finished turning (opened completely), the cam follower 71 is moved onto the placed face 74 of the upper end part (refer to FIGS. 13 and 16).

In such a state, the lower end face of the shading member 48 is positioned at the upper side from an upper face of the cap 50 (correctly, from the opening face at the upper side of the collecting port 51*a* of the cap main body 51). That is, the interlocking device 49 pushes up the shading member 48 to separate it from the optical sensor 46. The interlocking device 49 moves the shading member 48 to a position withdrawn from the attaching/detaching path of the waste toner case 45. At this time, the cam follower 71 is pressured to the placed face 74 by the pressure spring 68. Therefore, a state of the cover 47 being completely opened is maintained.

Consequently, the waste toner case 45 installed into the installation space 2*b* is exposed. Therefore, the user can detach the waste toner case 45 in the already described manner. Then, the collected waste toner is shifted to subsequent processing step, such as recycling.

Next, the user installs, for example, an empty waste toner case 45 into the installation space 2*b* in the already described manner. After that, in order to close the cover 47, the user turns the cover 47 backward. Then, in contrast to the opening of the cover 47, the cam follower 71 is moved downward from the placed face 74 of the upper end part along the inclined face 73. The shading member 48 biased by the pressure spring 68 is also moved downward. Then, when the cover 47 is completely closed, the cam follower 71 is moved onto the placed face 74 of the lower end part. That is, the work is returned to the initial condition (refer to FIG. 11). The hook part 65 is stopped in an engaged state with the apparatus main body 2's side. Therefore, the state of the cover 47 being closed is maintained.

As mentioned above, in the initial condition, the shading member 48 is positioned so as to cover the optical sensor 46. At this time, the arm parts 67 of the shading member 48 are biased downward by the biasing force of the pressure spring 68 and pressured onto the flange part 51*b* of the cap main body 51 (refer to FIG. 15). The pressure spring 68 has a function of acting directing the arm parts 67 to the flange part 51*b* as the circumference edge of the collecting port 51*a* by the biasing force, and furthermore, a function of acting as the interlocking device 49 to move the shading member 48 downward.

In the color printer 1 according to the embodiment mentioned above, in a state where the optical sensor 46 is covered by the cover 47 of the apparatus main body 2, the optical sensor 46 is further covered by the shading member 48. That is, the optical sensor 46 is shaded twice. Therefore, the light transmitted through the cover 47 is obstructed by the shading member 48. Thus, the optical sensor 46 can carry out correct detection without being affected by external light (disturbance). Thereby, it is possible to prevent a problem that, regardless of filling the waste toner case 45 with the waste toner, the external light is inputted into the light reception part 61 and fill detection is not carried out, and other problems. That is, it is possible to prevent failure in the fill detection in the optical sensor 46.

In addition, in the color printer 1 according to the embodiment, the arm parts 67 of the shading member 48 is pressured to the flange part 51*b* by the biasing force of the pressure spring 68. Therefore, the waste toner case 45 is positioned and fixed in the installation space 2*b*. That is, the second delivery port 44 and collecting port 51*a* are connected to each other (correctly, connected to the main body side seal 40*a*) without being out of place. Therefore, it is possible to prevent leak of the waste toner from the connecting portion. Furthermore, the shading member 48 has a function covering the optical sensor 46 in the closed state of the cover 47 and a function positioning the waste toner case 45. Thereby, for example, it is possible to omit a dedicated member for positioning the waste toner case 45 to the apparatus main body 2. Therefore, it is possible to hold the waste toner case 45 by a simple structure.

Moreover, the cam follower 71 comes into slidable contact with the orbital face 72 of the cam 70. Therefore, the interlocking device 49 moves the shading member 48 downward as the cover 47 is closed, and moves the shading member 48 upward as the cover 47 is opened. Thus, the shading member 48 is moved between a position to cover the optical sensor 46 and a position separated upward from the optical sensor 46 in accordance with the opening/closing (turning) operation of the cover 47. Thereby, the user can easily carry out the replacement work of the waste toner case 45 by opening/closing the cover 47 regardless of the position of the shading member 48. Furthermore, as the interlocking device 49, a cam mechanism composed of the cam 70 and cam follower 71 provided in the turn supporting part 62 of the cover 47, and cam follower 71 is applied. Therefore, it is possible to secure correct operation with little malfunction in saved space.

Although, in the embodiment, the cam 70 is arranged at the cover 47's side and the cam follower 71 is arranged at the shading member 48's side, these arrangements are not restricted. The cam follower 71 may be arranged at the cover 47's side and the cam 70 may be arranged at the shading member 48's side.

While the preferable embodiment and its modified example of the color printer 1 of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a waste toner case attachably/detachably provided in an apparatus main body via an opening part to collect a waste toner ejected from an image forming part forming an image by a toner;

an optical sensor detecting whether or not the waste toner case is filled with the waste toner;

a cover turnably closing the opening part of the apparatus main body;

a shading member arranged between the cover and the optical sensor to cover the optical sensor in a state where the waste toner case is attached in the apparatus main body and the cover is closed; and an interlocking device interlocking the opening/closing operation of the cover to move the shading member;

wherein the shading member is moved between a position to cover the optical sensor in a state where the cover closed and a position separated from the optical sensor in a state where the cover opened.

2. The image forming apparatus according to claim 1, wherein the interlocking device interlocking opening operation of the cover to withdraw the shading member from an attaching/detaching path for the waste toner case.

3. The image forming apparatus according to claim 2, wherein the cover is turnably supported by one end in left and right directions of the opening part, the interlocking device includes:

a cam arranged in one of the cover and the shading member; and a cam follower protruded in another of the cover and the shading member.

4. The image forming apparatus according to claim 3, wherein the cam has:

a spiral orbital face, with which the cam follower comes into slidable contact, moving the shading member downward as the cover is closed and moving the shading member upward as the cover is opened.

5. The image forming apparatus according to claim 4, wherein the orbital face has:

an inclined face inclined in a direction of closing the cover; and two substantially horizontal faces formed to respectively continue to an upper end part and a lower end part of the inclined face.

6. The image forming apparatus according to claim 5, wherein the cam follower is configured to be moved along the inclined face when the cover is turned, and to be moved to one of the substantially horizontal faces in a state of the cover being completely opened or a state of the cover being completely closed.

7. The image forming apparatus according to claim 1, wherein the waste toner case has a collecting port for conveying the waste toner into the waste toner case, and the shading member includes:

a shading plate covering the optical sensor;

an arm part coming into contact with a circumferential edge of the collecting port in the state where the cover is closed; and a pressure spring biasing the arm part to the circumferential edge of the collecting port.

* * * * *